US008161644B2

(12) United States Patent
Lin et al.

(10) Patent No.: US 8,161,644 B2
(45) Date of Patent: Apr. 24, 2012

(54) LEVELING METHOD FOR BURYING EVAPORATING SECTION OF HEAT PIPE INTO THERMALLY CONDUCTIVE SEAT

(75) Inventors: Kuo-Len Lin, Wugu Township, Taipei County (TW); Chen-Hsiang Lin, Wugu Township, Taipei County (TW); Hwai-Ming Wang, Wugu Township, Taipei County (TW); Ken Hsu, Wugu Township, Taipei County (TW); Chih-Hung Cheng, Wugu Township, Taipei County (TW)

(73) Assignees: Golden Sun News Techniques Co., Ltd., Taipei County (TW); CPUmate Inc, Taipei County (TW)

( * ) Notice: Subject to any disclaimer, the term of this patent is extended or adjusted under 35 U.S.C. 154(b) by 547 days.

(21) Appl. No.: 12/477,471

(22) Filed: Jun. 3, 2009

(65) Prior Publication Data

US 2010/0083500 A1 Apr. 8, 2010

(30) Foreign Application Priority Data

Oct. 3, 2008 (TW) ..... 97138229 A

(51) Int. Cl.

| | |
|---|---|
| ***B21D 21/00*** | (2006.01) |
| ***B21D 39/06*** | (2006.01) |
| ***B21D 53/02*** | (2006.01) |
| ***B23P 6/00*** | (2006.01) |

(52) U.S. Cl. ..... 29/890.032; 29/890.03; 29/890.043; 29/890.053

(58) Field of Classification Search ..... 29/890.03, 29/890.032, 890.035, 890.043, 890.045, 29/890.53; 165/104.21
See application file for complete search history.

(56) References Cited

U.S. PATENT DOCUMENTS

| | | | | |
|---|---|---|---|---|
| 2009/0049691 | A1* | 2/2009 | Cheng et al. | 29/890.03 |
| 2010/0122799 | A1* | 5/2010 | Lin et al. | 165/104.26 |
| 2011/0114293 | A1* | 5/2011 | Lin et al. | 165/104.26 |
| 2011/0203773 | A1* | 8/2011 | Teraki et al. | 165/104.19 |
| 2011/0315365 | A1* | 12/2011 | Chen | 165/185 |
| 2011/0315366 | A1* | 12/2011 | Chen | 165/185 |

OTHER PUBLICATIONS

European research report having a mail date of Apr. 20, 2009.

* cited by examiner

*Primary Examiner* — Alexander P Taousakis
(74) *Attorney, Agent, or Firm* — Chun-Ming Shih; HDLS IPR Services

(57) ABSTRACT

A leveling method for burying an evaporating section of a heat pipe into a thermally conductive seat is provided for an assembly of heat pipe and heat-conducting seat by simultaneously making the evaporating section of heat pipe partially formed into a flat surface when the evaporating section of heat pipe is being burying into the thermally conductive seat. Furthermore, in cooperation with a stamping machine, the leveling method is to make a multiple steps of press-fitting process to an evaporating section of heat pipe under a condition that there is no need to change the stamping die.

9 Claims, 16 Drawing Sheets

LEVELING METHOD FOR BURYING EVAPORATING SECTION OF HEAT PIPE INTO THERMALLY CONDUCTIVE SEAT

BACKGROUND OF THE INVENTION

1. Field of the Invention

The present invention in general relates to a manufacturing method of cooler, in particular, to an assembling method for heat pipe and thermally conductive seat of cooler; in other words, the present invention relates to an assembly for burying evaporating section of heat pipe into thermally conductive seat, especially, to a leveling method for making the evaporating section partially formed into a flat surface simultaneously.

2. Description of Prior Art

Accordingly, as shown in FIG. 1, it is a perspective illustration of prior heat pipe that has been press-fitted. In this case, a heat pipe 1*a* is to form an evaporating section 10*a* on one section thereof. In order to make the evaporating section 10*a* able to contact the heat source through a surface-to-surface manner, a top part of the evaporating section 10*a* is flattened to form a flatter heated surface 100*a*. However, during the pressing process, since the pressing surface of the die is a flat surface while the pressed surface of the evaporating section is an arch, the point contact gradually becomes a surface contact, when the flat surface is contacting the arch surface. Therefore, it is easy to generate a stress-concentrating problem due to the initial point contact, whereby an indentation 101*a* recessed inwardly is formed on the heated surface 100*a* of the heat pipe 1*a*. Thus, after the press-fitting process, it is still necessary to make a grinding process to the heated surface 100*a* of the heat pipe 1*a* to get rid of the indentation 101*a*.

Moreover, in the past, in order to solve such kind of problem, a prior art had tried to gradually level the evaporating section of heat pipe, through a two steps' press-fitting process. But, since a press-fitting recession with different depth must be formed in each pressing die to gradually press the evaporating section of heat pipe into a flat surface through multiple steps that are executed one by one. Therefore, during the prior process, in order to reach a press-fitting formation through multiple steps made to the evaporating section of the heat pipe, the pressing dies must be changed more than once to avoid the aforementioned drawbacks from happening again to the flat heated surface to be formed.

In view of this, in order to make the evaporating section of heat pipe partially formed into a flat surface without the inconvenience and drawbacks caused by a multiple steps' press-fitting process, namely, the pressing dies having to be changed many times during an assembly for the heat pipe and the thermally conductive seat. The inventor, after a substantially devoted study, in cooperation with the application of relatively academic principles, has finally proposed the present invention that is designed reasonably to possess the capability to improve the prior arts significantly.

SUMMARY OF THE INVENTION

The invention is mainly to provide a leveling method for burying evaporating section of heat pipe into thermally conductive seat to solve the aforementioned problem under a condition that there is no need to change any pressing die. In the invention, in cooperation with a stamping machine, when the evaporating section of heat pipe is burying into a thermally conductive seat, a flat surface is simultaneously formed on a top of the evaporating section, thus that the purpose of production with good quality is achieved.

Secondly, the invention is to provide a leveling method for burying evaporating section of heat pipe into thermally conductive seat, the process including following steps:

a) prepare at least one heat pipe, a thermally conductive seat to be thermally connected to the heat pipe, and arrange at least one groove at a bottom surface of the thermally conductive seat for burying the evaporating section reserved in the heat pipe;

b) lay the evaporating section of heat pipe into the groove of the thermally conductive seat, for being fixed in a fixture together;

c) dispose the fixture of step b onto a stamping machine that includes a platform, on which a plurality of machining positions for sequentially positioning the fixture are provided; and a punch, which is arranged above the platform and interspaced the platform correspondingly, and which can process a pressing down motion toward the platform, and on which a plurality of pressing dies are arranged, which correspond to each machining position respectively, and each an under face of which is a press-fitting surface formed, on which an indentation is formed with a depth varying from deepness to shallowness according to the sequence of each machining position, and one of which is a flat surface;

d) according to the machine of step c, the fixture is laid onto each machining position in sequence, at each machining position, making each pressing die execute a pressing down motion to the evaporating section of the heat pipe, thereby, a flat surface being gradually formed on a top of the evaporating section.

Thereby, under a condition that there is no need to change any pressing die, a leveling method of good quality to bury evaporating section of heat pipe into thermally conductive seat is thus obtained.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE INVENTION

In cooperation with attached drawings, the technical contents and detailed description of the present invention are described thereinafter according to a number of preferable embodiments, not used to limit its executing scope. Any equivalent variation and modification made according to appended claims is all covered by the claims claimed by the present invention.

Figure 1:
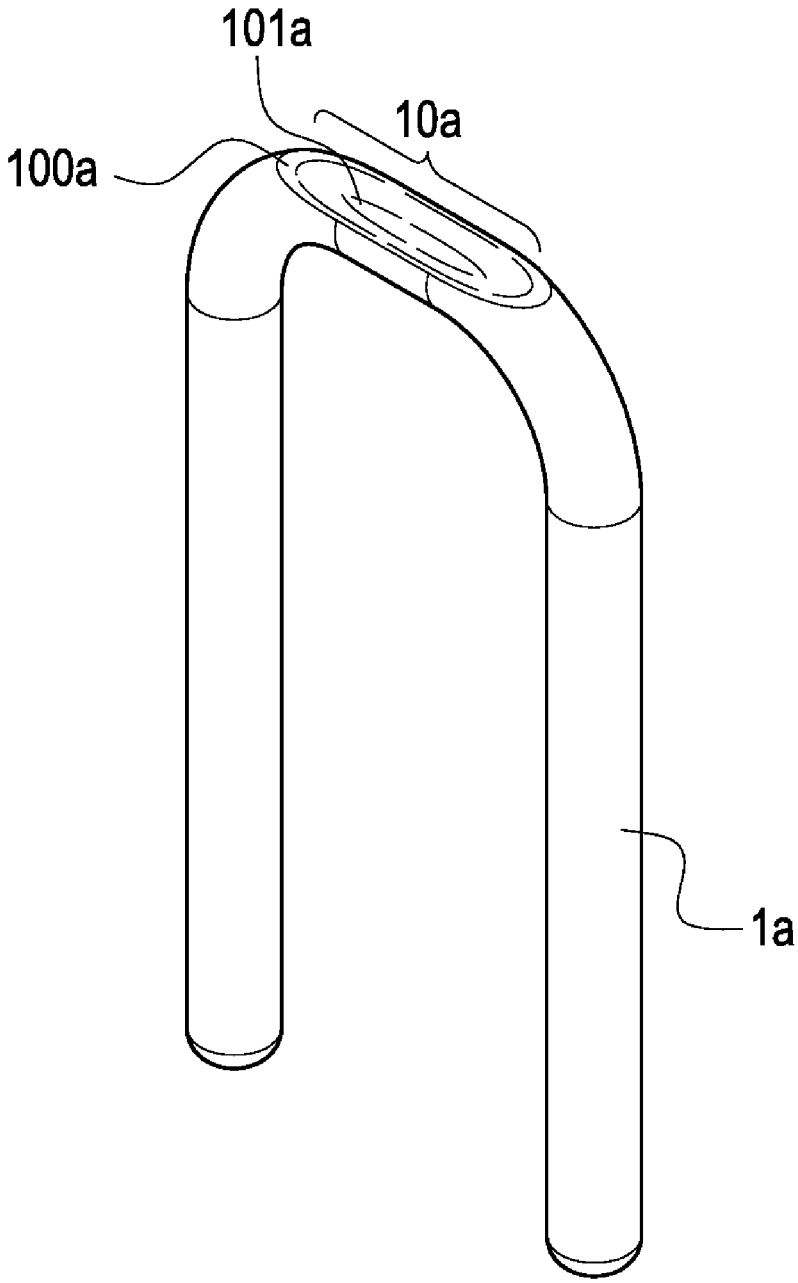
FIG.1 PRIOR ART
FIG. 1 is a perspective illustration of a heat pipe according to the prior arts, in which the heat pipe has been press-fitted already.
Figure 2:
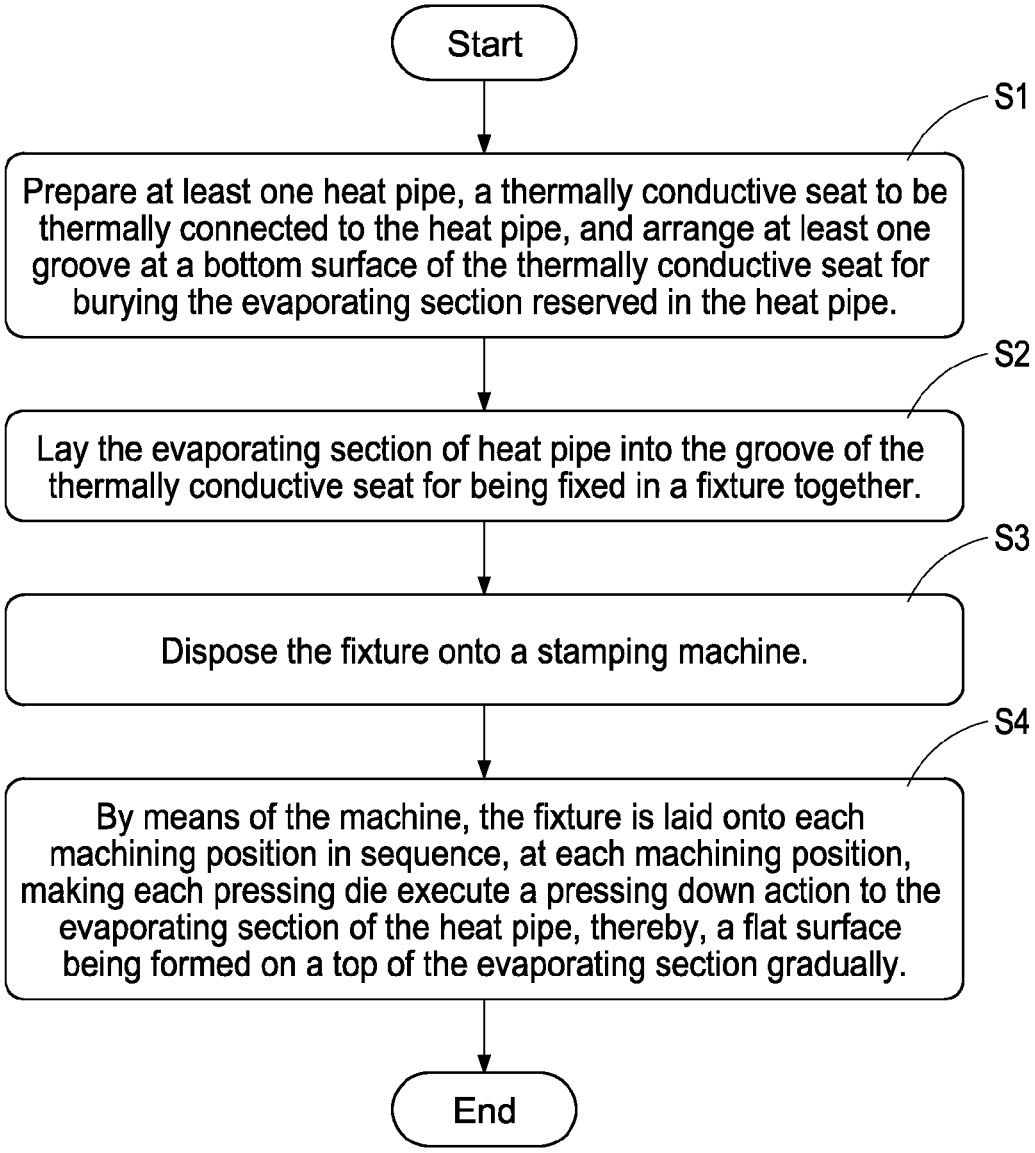
FIG. 2 is a step flowchart according to the present invention.

Please refer to FIG. 2, which is a step flowchart according to the present invention. The invention is to provide a leveling method for burying evaporating section of heat pipe into thermally conductive seat. According to the present invention, at least one evaporating section of heat pipe is buried into a bottom surface of a thermally conductive seat. When the bottom surface of the thermally conductive seat contacts a heat source, a heated surface that is leveled can be formed on the evaporating section of the heat pipe, such that a surface-to-surface thermal contact can be directly made between the heat pipe and the heat source. The steps of leveling method are described as the following.

Figure 3:
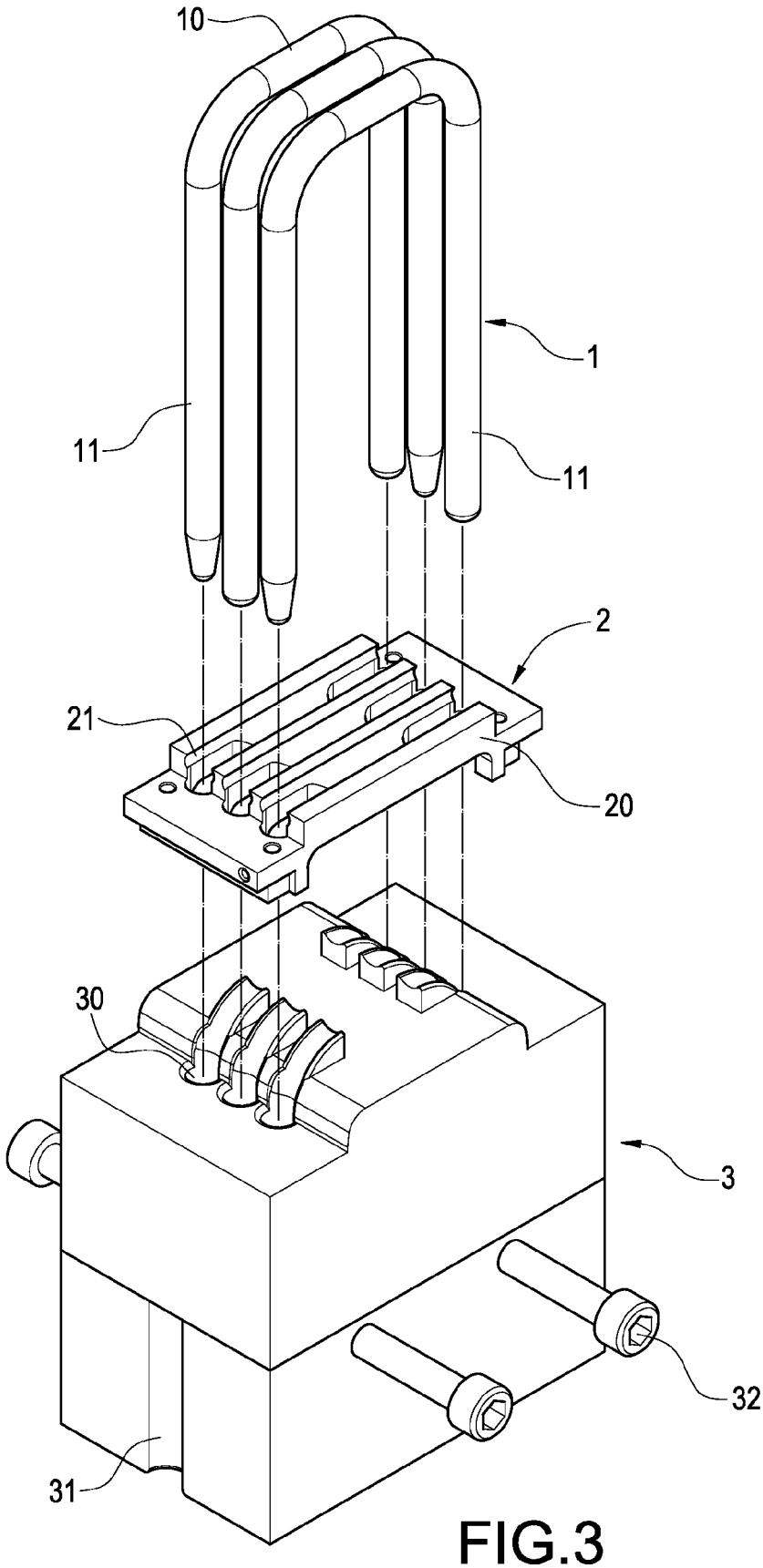
FIG. 3 is a perspective explosive view of the heat pipe, the thermally conductive seat and the fixture according to the present invention.

Please refer to FIG. 3, in cooperation with the step S1 shown in FIG. 2, in which at least one heat pipe 1 and a thermally conductive seat 2 capable of making thermal connection with the heat pipe 1 are provided. Furthermore, to bury an evaporating section 10 reserved in the heat pipe 1 into the thermally conductive seat 2, a groove 21 at a bottom surface 20 of the thermally conductive seat 2 is provided, whereby the evaporating section 10 of the heat pipe 1 can be laid in the groove 21.

Figure 4:
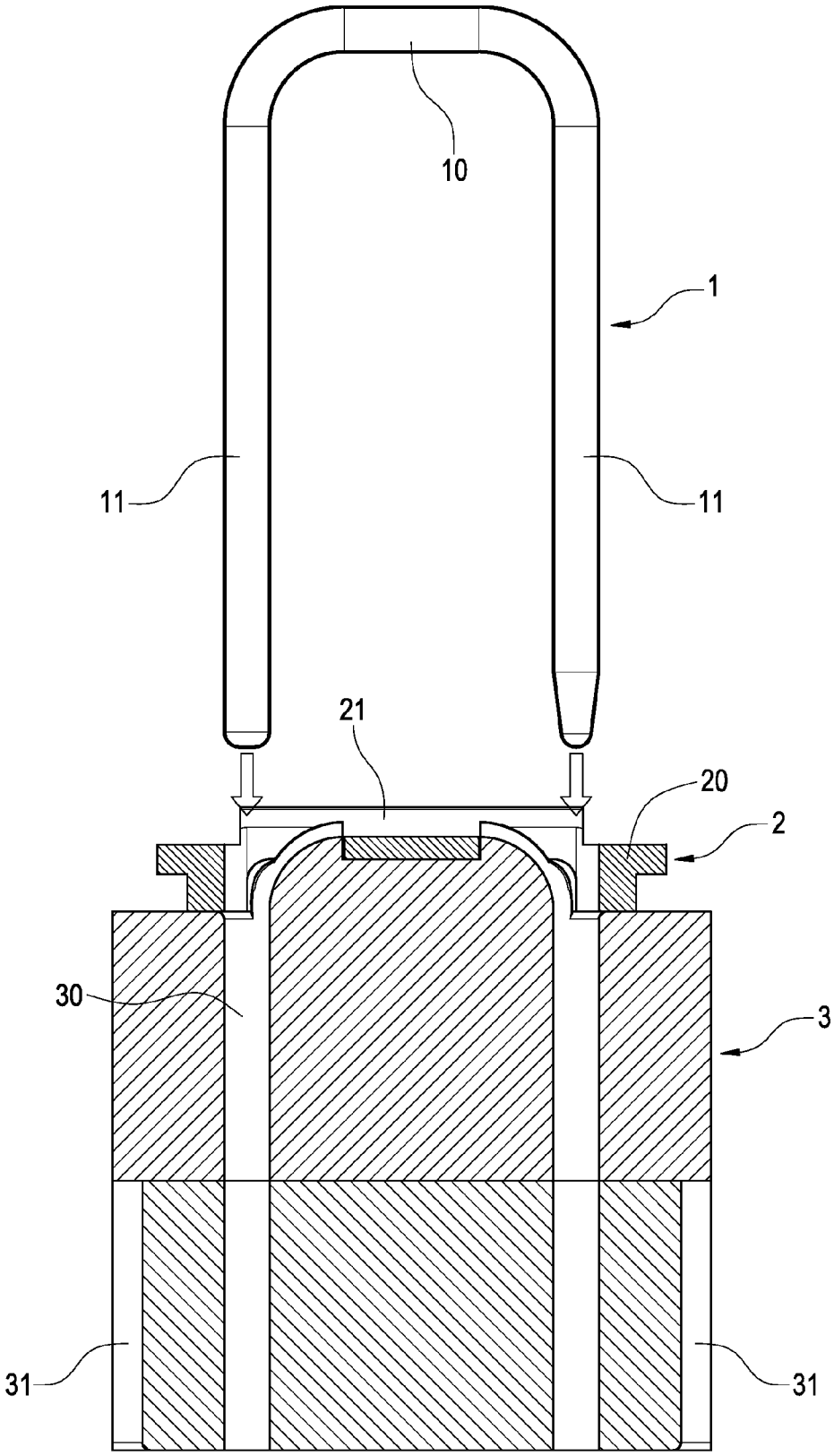
FIG. 4 is an illustration showing an assembling motion of the heat pipe, the thermally conductive seat and the fixture according to the present invention.
Figure 5:
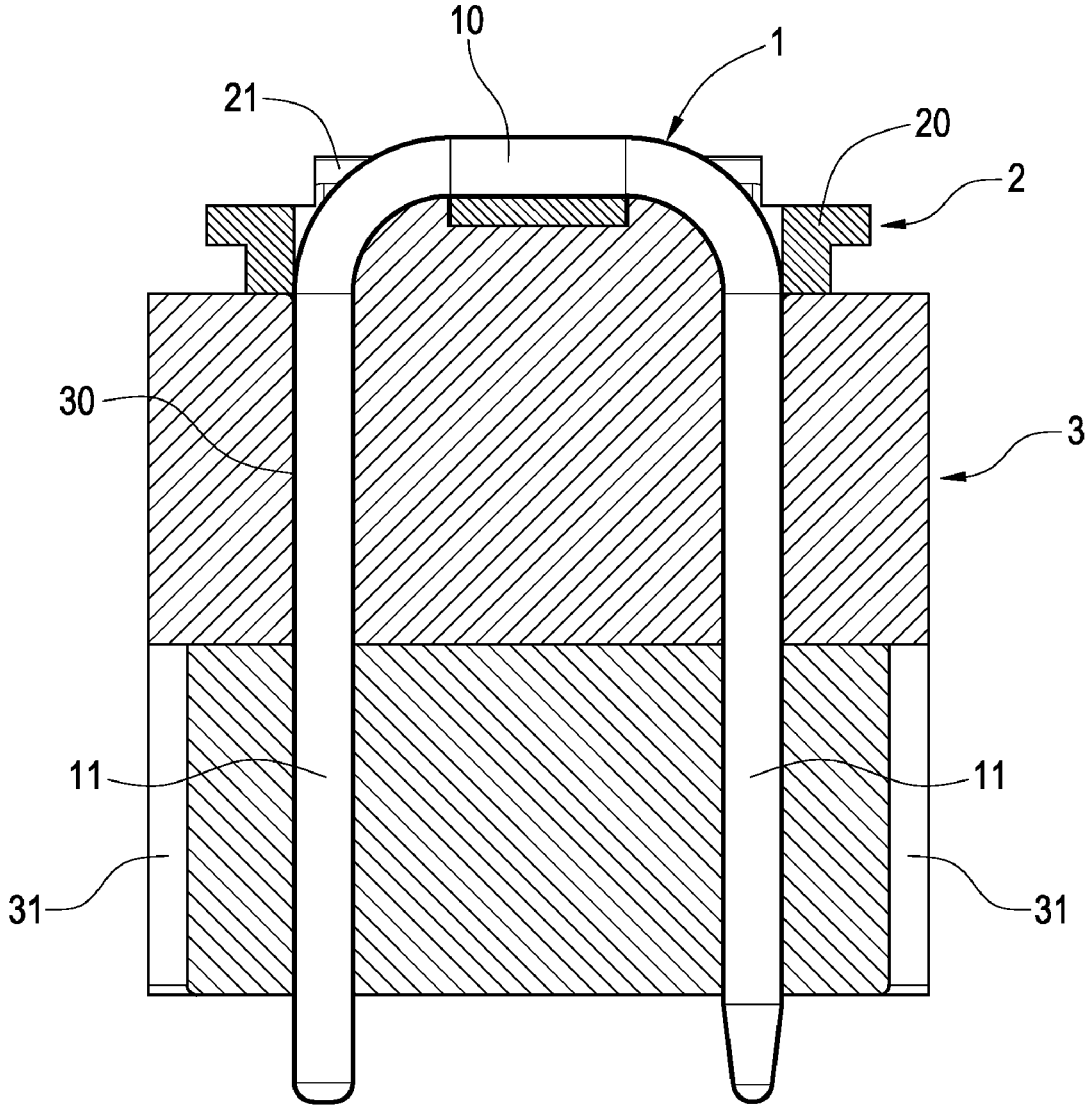
FIG. 5 is an illustration showing a completed assembly of the heat pipe, the thermally conductive seat and the fixture according to the present invention.
Figure 6:
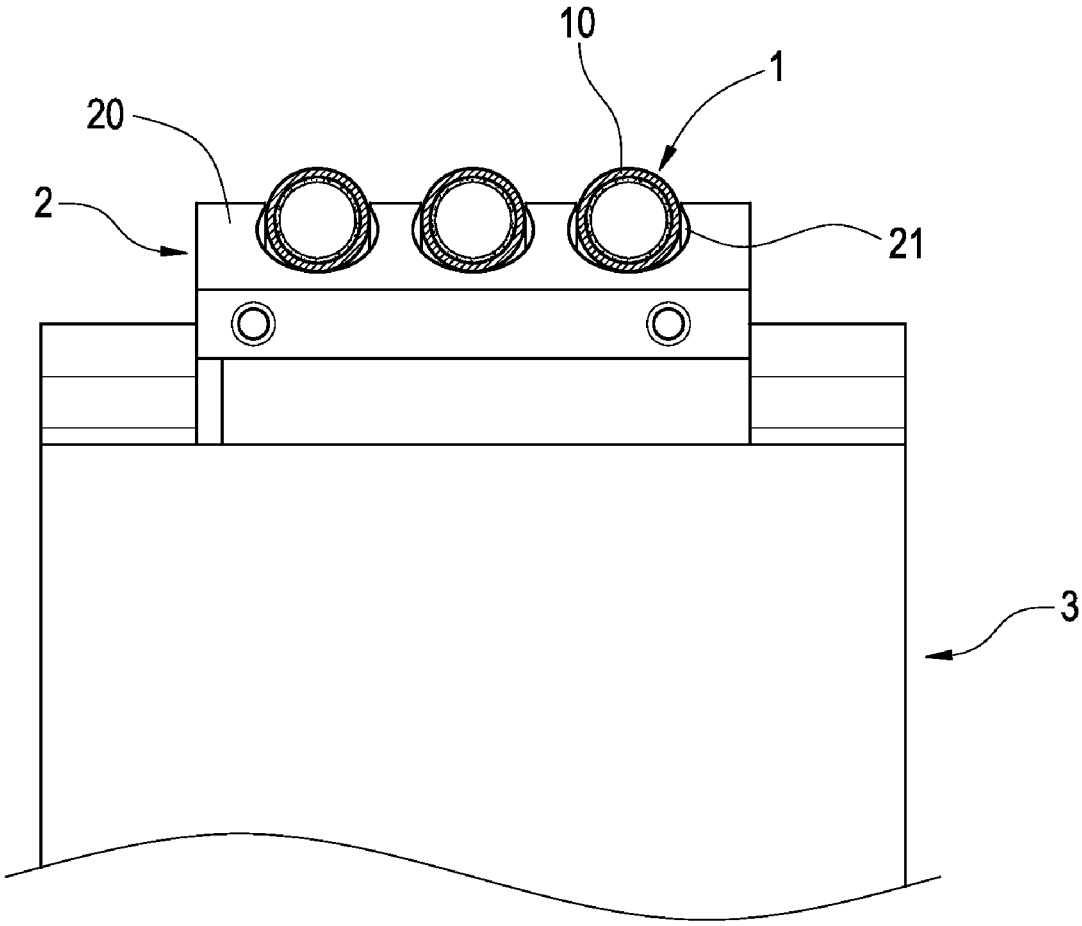
FIG. 6 is a cross-sectional view of the present invention.

Please refer to FIG. 4 and FIG. 5, in cooperation with the step S2 shown in FIG. 2, in which the evaporating section 10 of the heat pipe 1 to be secured in a fixture 3 is laid in the groove 21. In this case, the fixture 3 can be cooperated to make the condensing section 11 reserved in the heat pipe 1 penetrate through a perforation 30, just making the evaporating section 10 of the heat pipe 1 positioned in the groove 21 of the thermally conductive seat 2, after the condensing section 11 extended from the heat pipe passes through a bottom part of the fixture 3. Again, please refer to FIG. 6 together, in which the groove 21 is substantially shown as an elliptical shape so, when the evaporating section 10 of the heat pipe 1 is laid in the groove 21, a part of the circumference of the evaporating section 10 is higher than the bottom surface 20 of the thermally conductive seat 2 and projects out of the groove 21. The projecting portion of the evaporating section 10 is to be press-fitted into a flat surface in the subsequent steps. In addition, as shown in FIG. 3, grips 32 can be latterly extended from the fixture 3 for being held by human hands conveniently.

Figure 7:
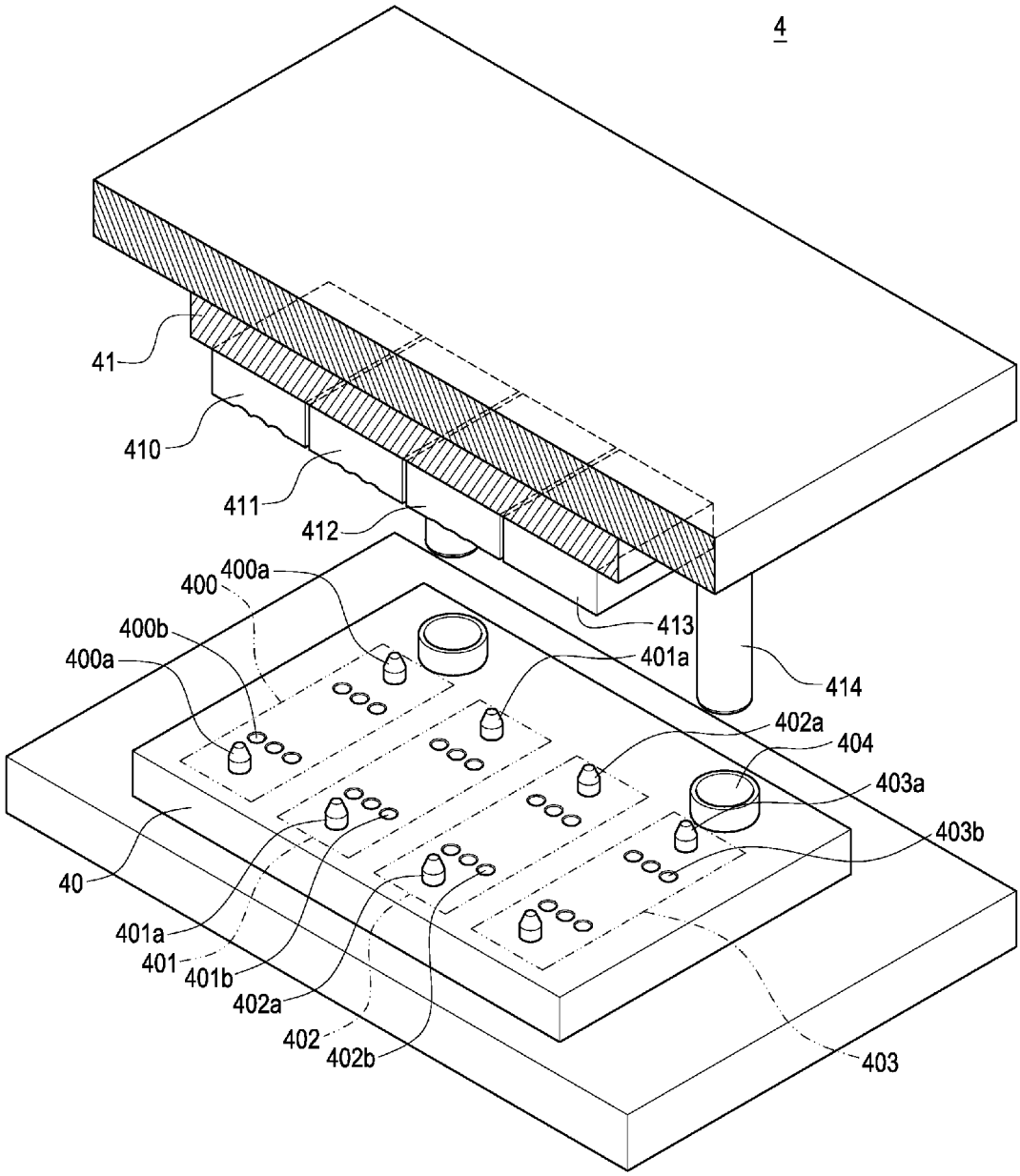
FIG. 7 is a perspective illustration of a stamping machine according to the present invention.
Figure 8:
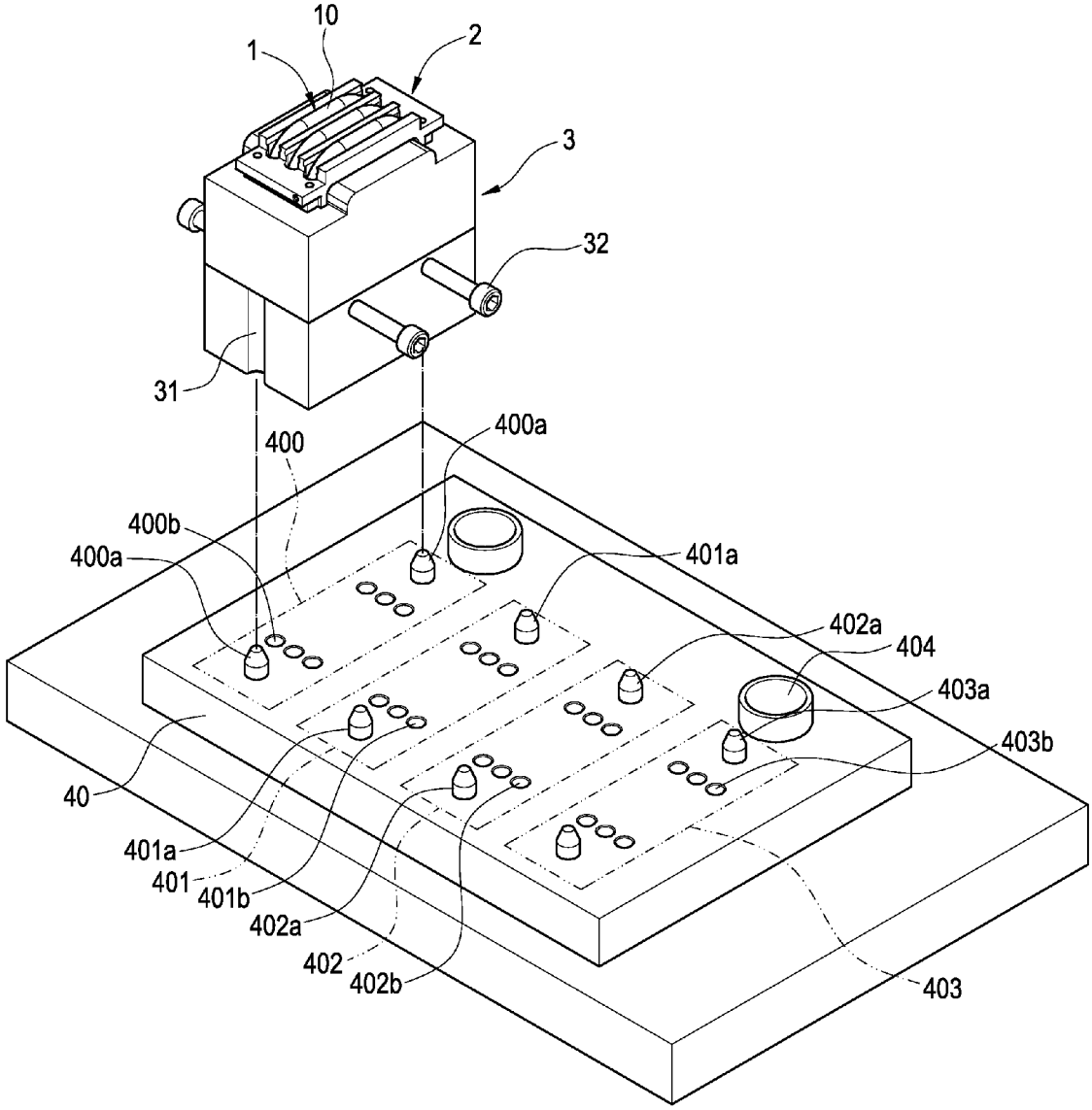
FIG. 8 is an illustration showing an assembling motion of a fixture arranged the heat pipe and the thermally conductive seat and a platform of the stamping machine according to the present invention.

Please refer to FIG. 7, in cooperation with the step S3 shown in FIG. 2, in which the fixture is placed onto a stamping machine 3. The stamping machine 3 includes a platform 40 and a punch 41 located above the platform 40 and interspaced relatively. On the platform 40, there are a plurality of machining positions arranged for positioning the fixture 3 in sequence. According to a preferable embodiment proposed by the present invention, the machining positions includes a first machining position 400, a second machining position 401, a third machining position 402 and a fourth machining position 403. The machining positions are arrayed crossly, on which a plurality of positioning pillars 400*a*, 401*a*, 402*a*, 403*a* in cooperation with the fixture 3 are arranged, as shown in FIG. 8. The positioning pillars 400*a*, 401*a*, 402*a*, 403*a* can be aligned to ditches 31 arranged at external sides of the fixture 3, making the fixture 3 accurately disposed on each machining position of the platform 40. In addition, since the condensing section 11 of the heat pipe 1 can penetrate through the bottom part of the fixture 3, a plurality of buried via holes 400*b*, 401*b*, 402*b*, 403*b* are respectively arranged at each machining position for the passage of the condensing section 11 extended from the heat pipe 1 such that, when the fixture 3 is disposed at each machining position, the condensing section 11 of the heat pipe 1 can be prevented from the damage caused by impact.

Figure 10A:
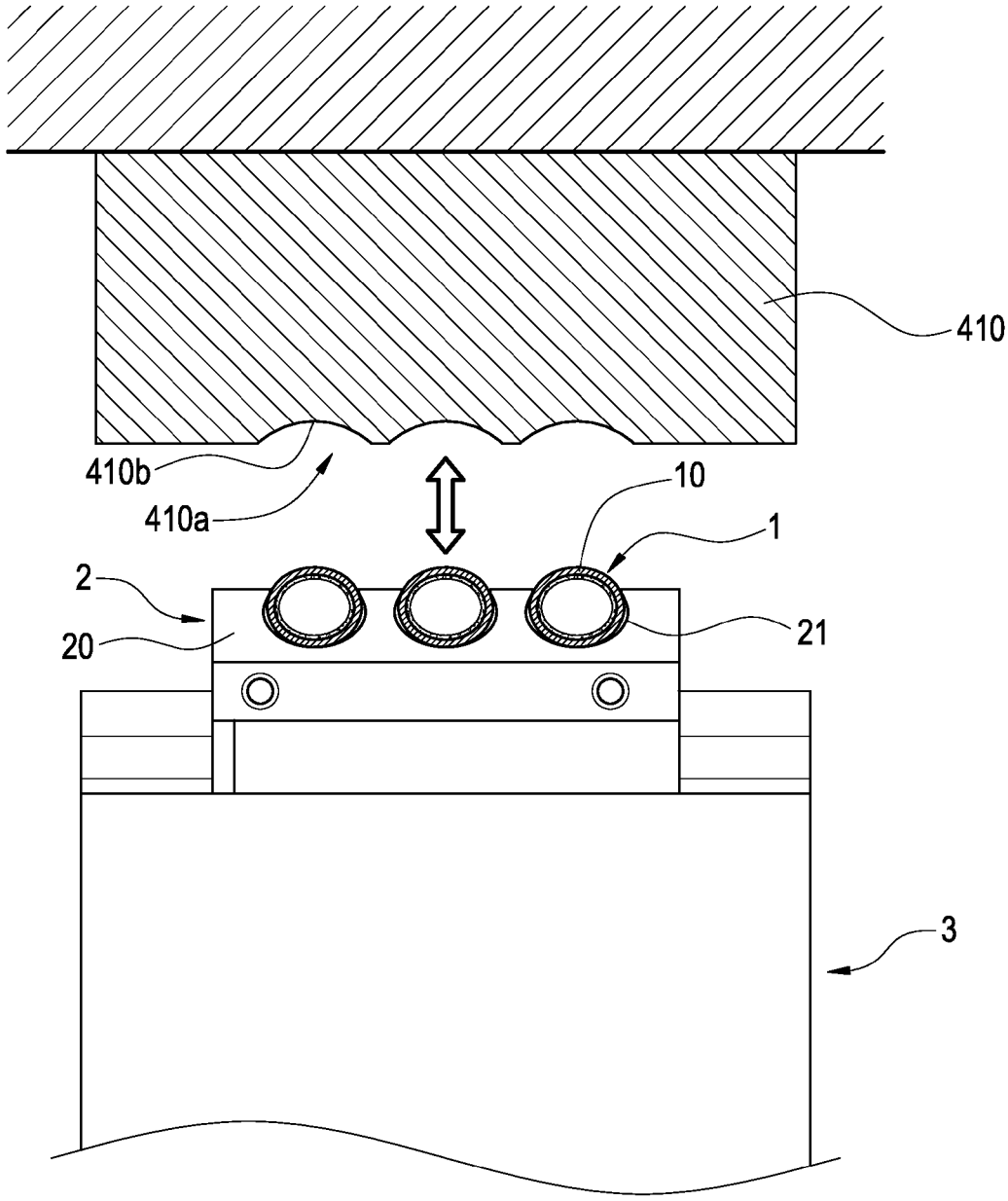
FIG. 10A is an illustration (1) showing that the invention executes a press-fitting action onto the evaporating section of the heat pipe in sequence.
Figure 10B:
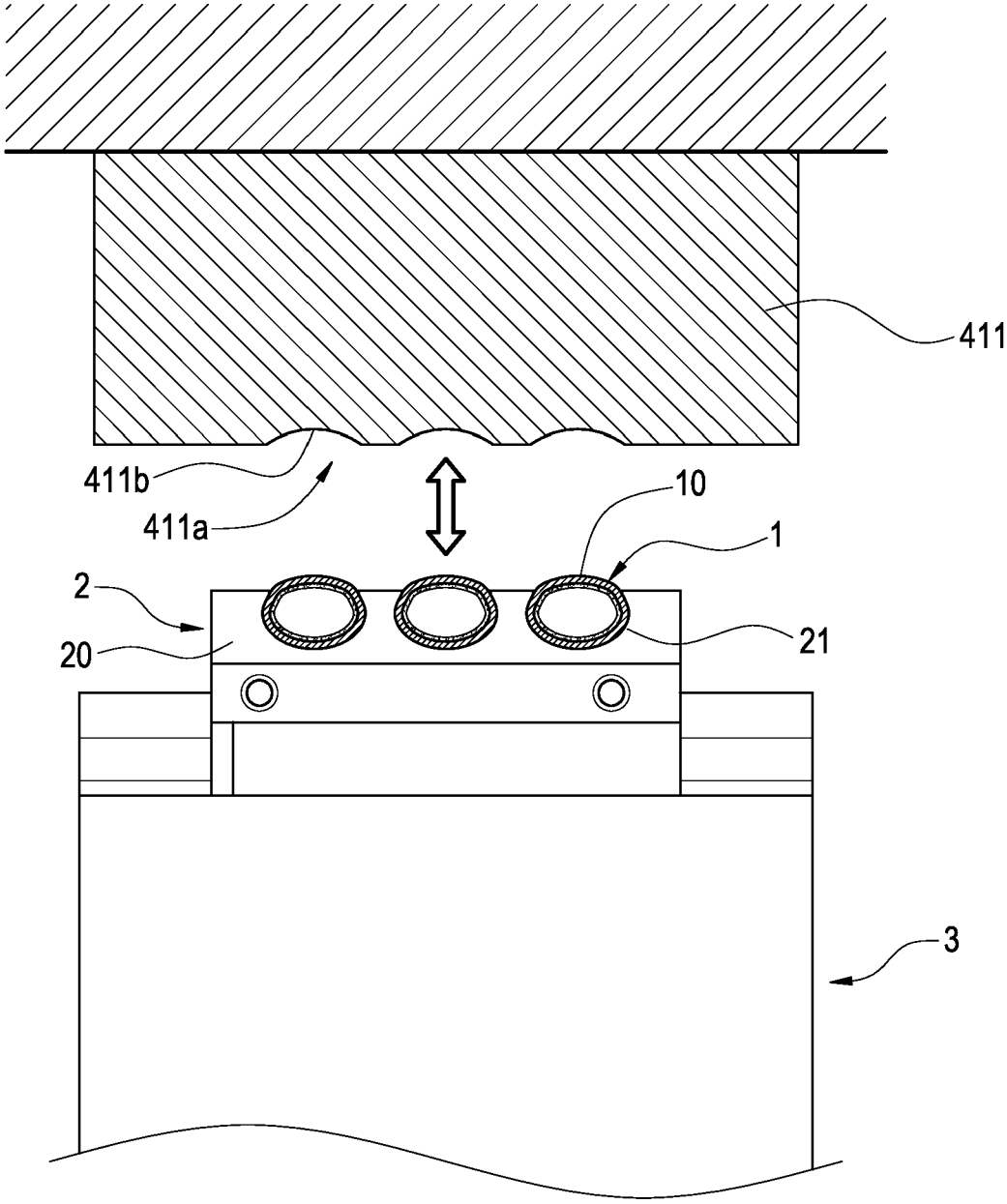
FIG. 10B is an illustration (2) showing that the invention executes a press-fitting action onto the evaporating section of the heat pipe in sequence.
Figure 10C:
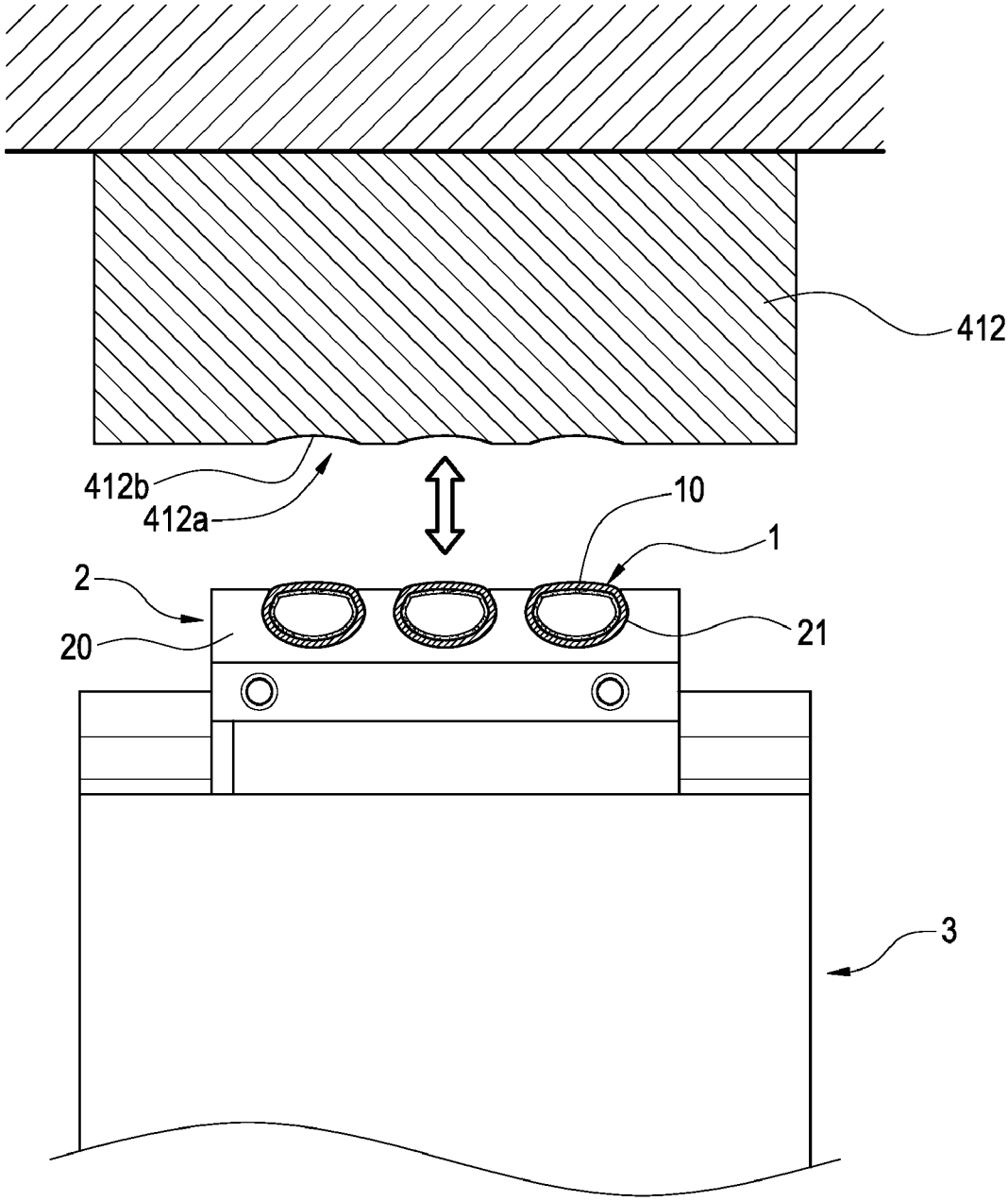
FIG. 10C is an illustration (3) showing that the invention executes a press-fitting action onto the evaporating section of the heat pipe in sequence.
Figure 10D:
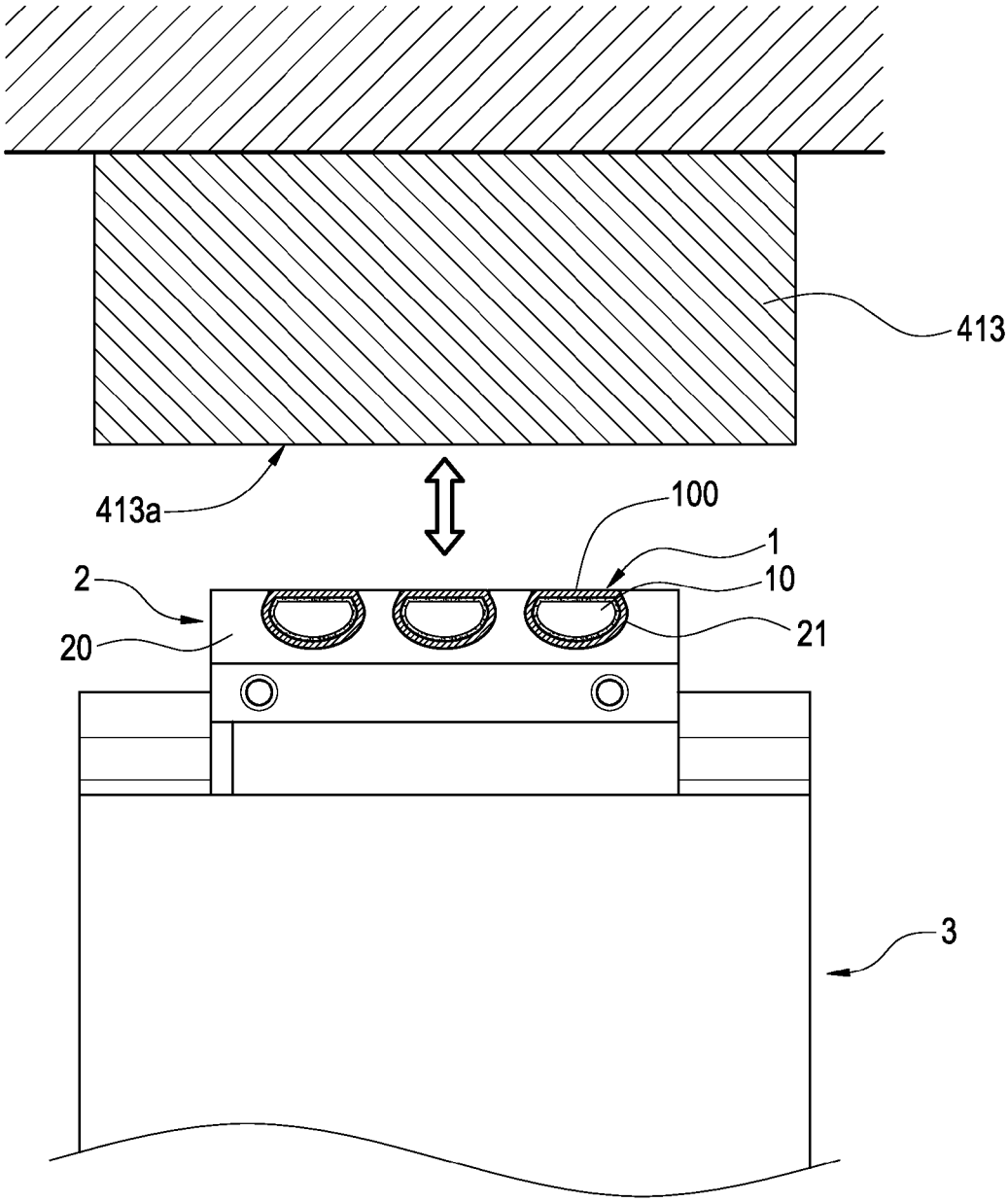
FIG. 10D is an illustration (4) showing that the invention executes a press-fitting action onto the evaporating section of the heat pipe in sequence.

According to the aforementioned description, the punch 41 of the stamping machine 4 can execute a pressing down action toward the platform 40. The punch 41 is arranged a plurality of pressing dies respectively corresponding to each positioning position. According to a preferable embodiment proposed by the present invention, the plurality of pressing dies includes a first pressing die 410, a second pressing die 411, a third pressing die 412 and a fourth pressing die 413, which respectively correspond to the first machining position 400, the second machining position 401, the third machining position 402 and the fourth machining position 403. First, please refer to FIG. 10A through FIG. 10D, which disclose the configurations of a first pressing die 410, a second pressing die 411, a third pressing die 412 and a fourth pressing die 413 according the preferable embodiments of the present invention, the under surfaces of which are respectively formed a press-fitting surface 410*a*, 411*a*, 412*a*, 413*a*, in which the press-fitting surfaces 410*a*, 411*a*, 412*a* of the first, second, third pressing dies 410, 411, 412 are cooperated to form the indentations 410*b*, 411*b*, 412*b* with depths varying from deepness to shallowness in sequence, while only the press-fitting surface 413*a* of the fourth pressing die 413 is a flat surface, namely, as shown in FIG. 10D.

In addition, the punch 41 of the stamping machine 4 is downwardly extended a plurality of guiding rods 414, which correspond to the guiding holes 404 located on the platform 40. In this case, the pressing down distances of the entire punch are maintained to a constant value, by controlling the pressing down depths provided by the guiding holes 404 for the guiding rods 414.

Figure 9:
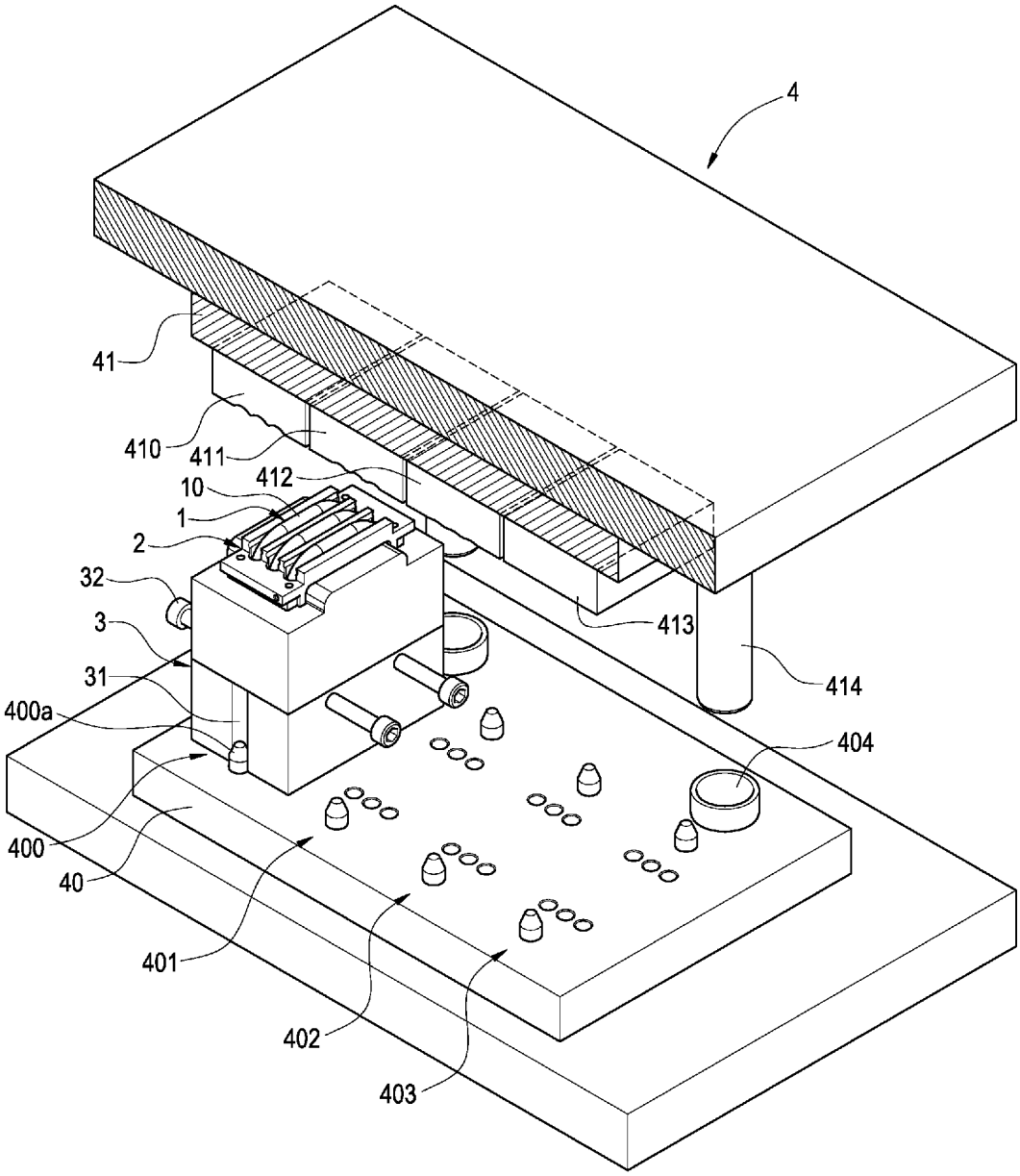
FIG. 9 is an assembly illustration showing a fixture arranged with the heat pipe and the thermally conductive seat to be altogether arranged to a stamping machine according to the present invention.
Figure 11:
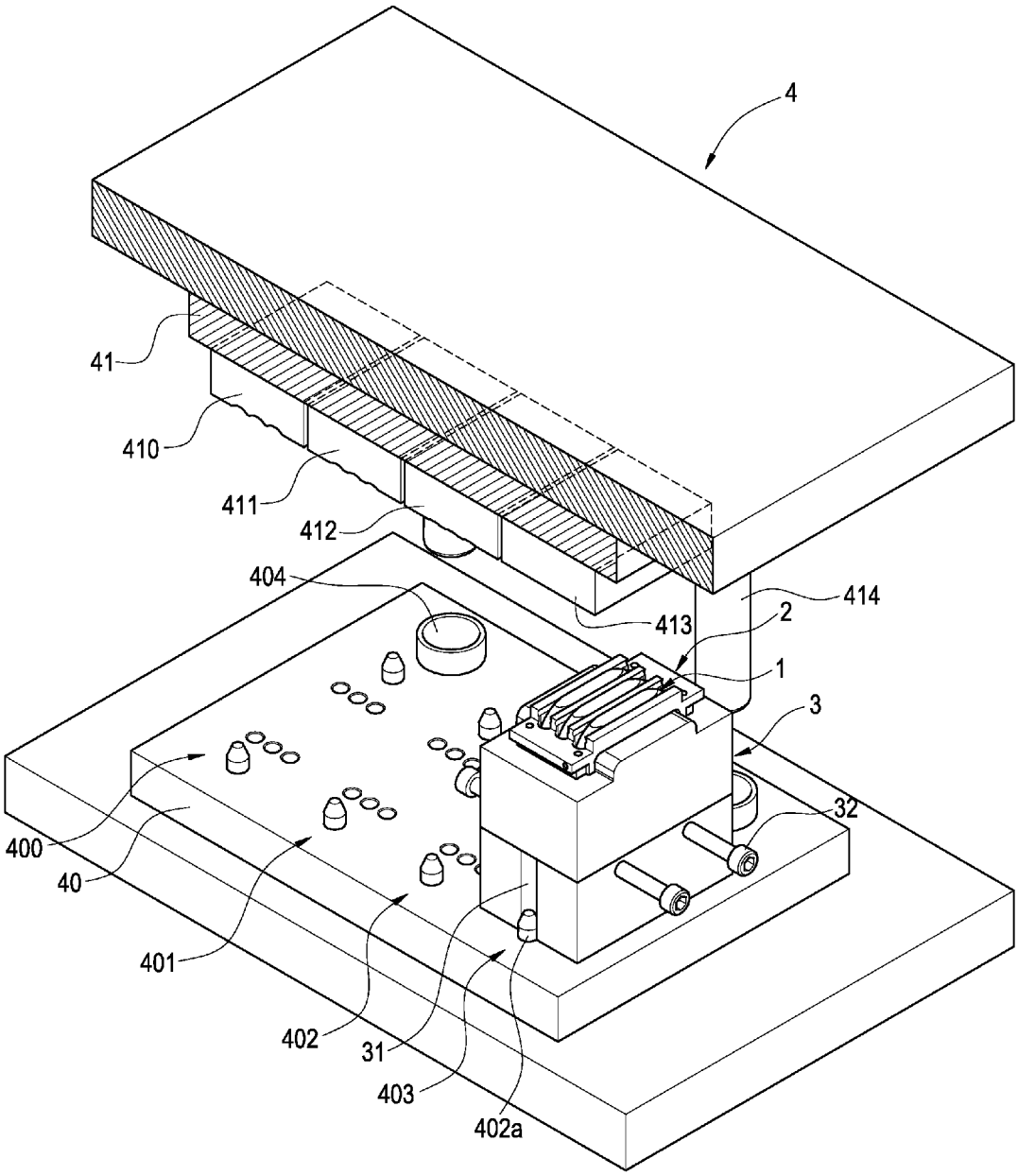
FIG. 11 is an assembly illustration showing that the stamping machine has completed the all steps executed to the fixture arranged with the heat pipe and the thermally conductive seat according to the present invention.

Please refer to FIG. 9 through FIG. 11, in cooperation with the step S4 shown in FIG. 2 in which, by means of the stamping machine 4, the fixture 3 is laid onto each machining position in sequence, making each pressing die execute a pressing down action to the evaporating section 10 of the heat pipe 1 in sequence, gradually and finally, making the evaporating section 10 formed into a flat surface 100. In other words, while the punch 41 is continuously undergoing a press-fitting process in an up and down manner periodically, starting from the first machining position and after press-fitted by the first pressing die 410, the fixture 3 is then moved to next machining position, namely, the second machining position, and so on. Until the fixture 3 has passed through the fourth machining position 403 shown in FIG. 11, the entire machining process is finished. Therefore, from FIG. 10A through FIG. 10D, it is known that, through the indentations 410*b*, 411*b*, 412*b* of the first, second, third pressing die 410, 411, 412 with a depth varying from deepness to shallowness and through a last press-fitting surface 413*a* shown as a flat surface on the fourth pressing die, the part of evaporating section 10 projecting out of the groove 21 can be gradually formed into a flat surface 100 as shown in FIG. 10D, after the evaporating section 10 of the heat pipe 1 is pressed by the pressing dies one by one. In the meantime, the pressing strokes can also make the evaporating section 10 of the heat pipe 1 buried into the groove 21 of the thermally conductive seat 2 gradually, such that an assembly operation for the heat pipe 1 and the thermally conductive seat 2 is completed.

Figure 12:
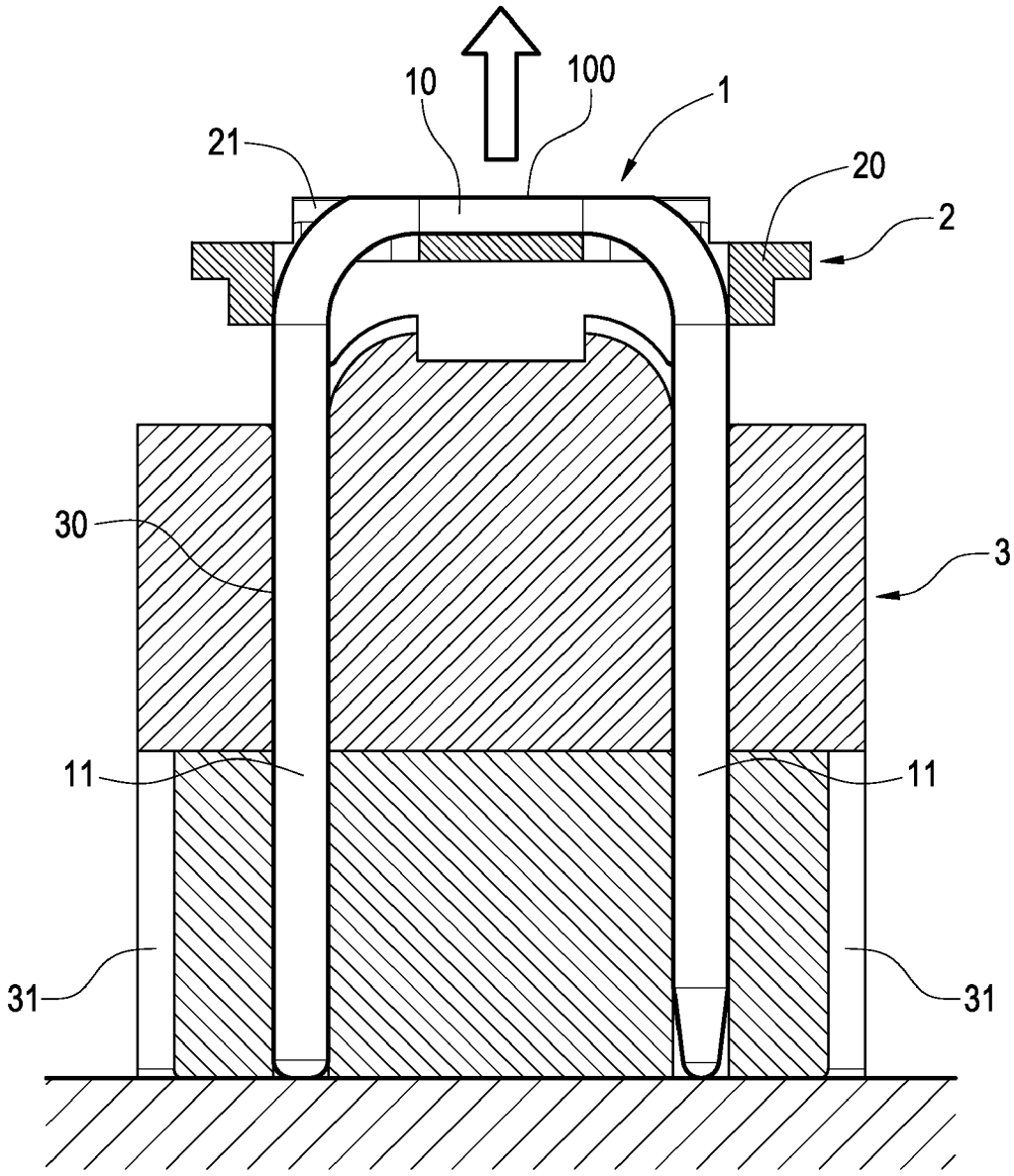
FIG. 12 is an action illustration showing that the heat pipe and the thermally conductive seat are being taken out of the fixture according to the present invention.
Figure 13:
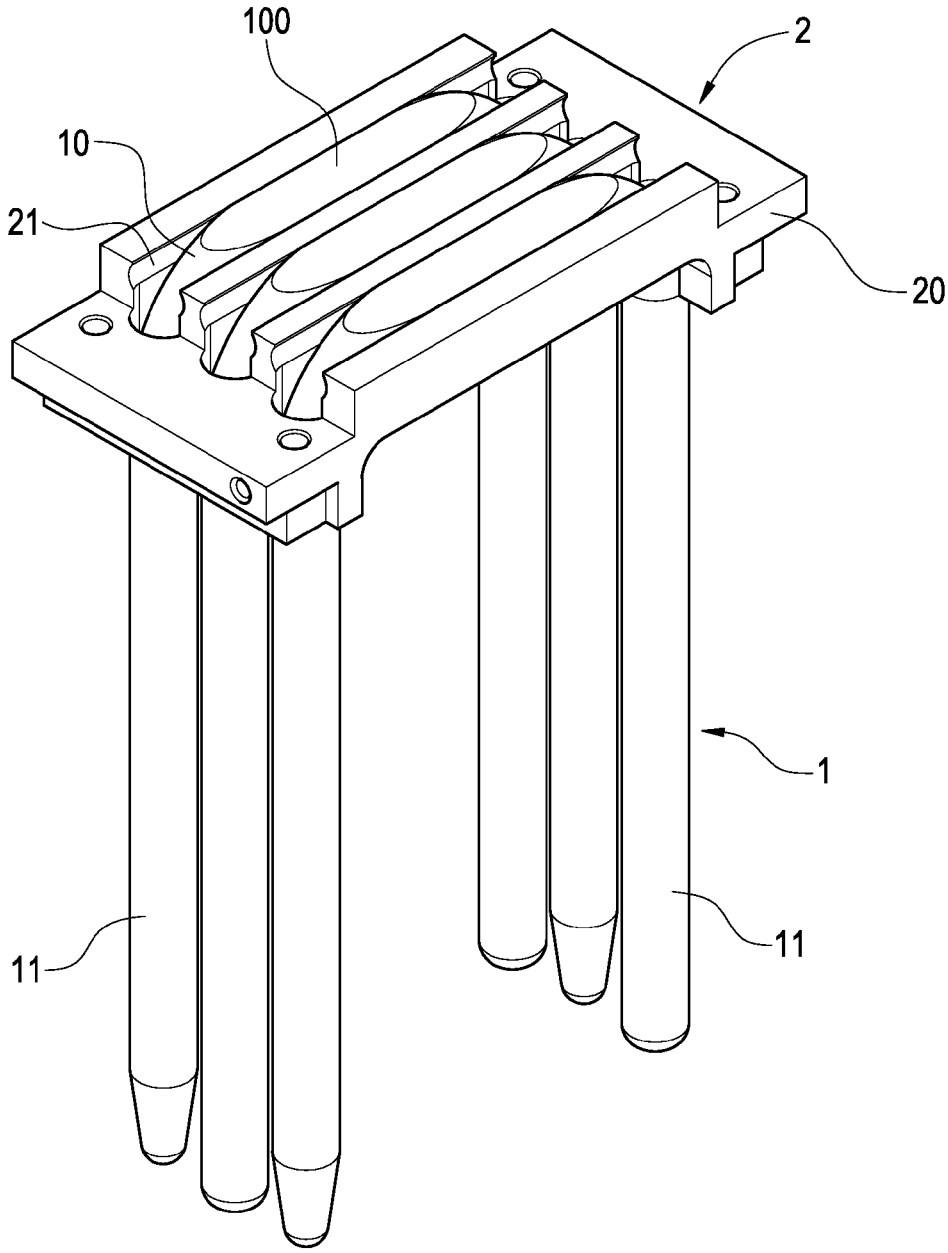
FIG. 13 is a perspective outer view of the heat pipes having the leveled evaporating sections according to the present invention.

Finally, after taking out the fixture 3 from the fourth machining position 403 on the stamping machine 4, as shown in FIG. 12, the part of the condensing section 11 of the heat pipe 1 projecting above the bottom part of the fixture 3 is then abutted against the working table in a careful manner, making the heat pipe 1 and the thermally conductive seat 2 separated from the fixture 3, thereby, a product of heat pipe 1 and thermally conductive seat 2 being thus successfully taken down.

Therefore, according to the aforementioned flowchart, a leveling method for burying evaporating section of heat pipe into thermally conductive seat of the invention is thus obtained.

Accordingly, by means of a leveling method for burying evaporating section of heat pipe into thermally conductive seat according to the present invention, not only a stress-concentrating problem occurred in press-fitting the heat pipe with a single stroke can be solved, but also inconvenience and drawback generated from a press-fitting process of multiple steps and from many changes of pressing dies can be further avoided. Moreover, since a heated surface shown as a flat configuration is formed on the evaporating section of the heat pipe, when the heat pipe directly contacts a heating element of electronic product, the contacting surface shown as a flat configuration can significantly enhance the thermally conductive effectiveness that should be possessed by a heat pipe.

Summarizing aforementioned description, the invention is an indispensable product of novelty indeed, which may positively reach the expected usage objective for solving the drawbacks of the prior arts, and which extremely possesses the innovation and progressiveness for completely fulfilling the applying merits of a new type patent, according to which the invention is thereby applied. Please examine the application carefully and grant it as a formal patent for protecting the rights of the inventor.

However, the aforementioned description is only a number preferable embodiments according to the present invention, not used to limit the patent scope of the invention, so equivalently structural variation made to the contents of the present invention, for example, description and drawings, is all covered by the claims claimed thereinafter.

What is claimed is:

1. A leveling method for burying an evaporating section of a heat pipe into a thermally conductive seat, including following steps:

a) preparing at least one heat pipe (1), a thermally conductive seat (2) to be thermally connected to the heat pipe (1), and arrange at least one groove (21) at a bottom surface (20) of the thermally conductive seat (2) for burying an evaporating section (10) reserved in the heat pipe (1) therein;

b) laying the evaporating section (10) of heat pipe (1) into the groove (21) of the thermally conductive seat (2) for being fixed in a fixture (3) together;

c) disposing the fixture (3) of step b) onto a stamping machine (4) that includes:

a platform (40), on which a plurality of machining positions (400, 401, 402, 403) for sequentially positioning the fixture (3) are provided; and a punch (41), which is arranged above the platform (40) and interspaced the platform (40) correspondingly, and which process a pressing down motion toward the platform (40), and on which a plurality of pressing dies (410, 411, 412, 413) are arranged, which correspond to each machining position (400, 401, 402, 403) respectively, and each under face of which is a press-fitting surface (410*a*, 411*a*, 412*a*, 413*a*) formed, on which an indentation (410*b*, 411*b*, 412*b*) is formed with a depth varying from deepness to shallowness according to the sequence of each machining position (400, 401, 402), and a last one of which (413*a*) is a flat surface;

d) according to the stamping machine (4) of step c), the fixture (3) being laid onto each machining position (400, 401, 402, 403) in sequence, at each machining position, making each pressing die (410, 411, 412, 413) execute a pressing down motion to the evaporating section (10) of the heat pipe (1) on the fixture (3), thereby, a flat surface (100) being gradually formed on a top of the evaporating section (10).

2. The leveling method for burying an evaporating section of a heat pipe into a thermally conductive seat according to claim 1, wherein the fixture (3) in step b) is in cooperation with a condensing section (11) of the heat pipe (1) to penetrate through a perforation (30), thereby, making the condensing section (11) penetrate through the perforation (30) and pass through a bottom part of the fixture (3) as well.

3. The leveling method for burying an evaporating section of a heat pipe into a thermally conductive seat according to claim 2, wherein a plurality of buried via holes (400*b*, 401*b*, 402*b*, 403*b*) are arranged on the machining positions (400, 401, 402, 403) for the passage of the condensing section (11).

4. The leveling method for burying an evaporating section of a heat pipe into a thermally conductive seat according to claim 2, further including a step e) that a part of the condensing section (11) of the heat pipe (1) projecting from the fixture (3) is abutted, making the heat pipe (1) and the thermally conductive seat (2) separated from the fixture (3), thus, successfully taking down a product of the heat pipe (1) and the thermally conductive seat (2).

5. The leveling method for burying an evaporating section of a heat pipe into a thermally conductive seat according to claim 1, wherein grips (32) are laterally extended from sides of the fixture (3) of the step b) for being griped by human hands.

6. The leveling method for burying an evaporating section of a heat pipe into a thermally conductive seat according to claim 1, wherein the plural machining positions (400, 401, 402, 403) on the stamping machine (4) of the step c) are respectively designated as a first machining position (400), a second machining position (401), a third machining position (402) and a fourth machining position (403), all of which (400, 401, 402, 403) are arrayed crossly over the platform (40) of the stamping machine (4).

7. The leveling method for burying an evaporating section of a heat pipe into a thermally conductive seat according to claim 6, wherein the machining positions (400, 401, 402, 403) are arranged a plurality of positioning pillars (400*a*, 401*a*, 402*a*, 403*a*), which are in cooperation with the fixture (3) and are aligned to the ditches (31) arranged at external sides of the fixture (3) for positioning the fixture (3).

8. The leveling method for burying an evaporating section of a heat pipe into a thermally conductive seat according to claim 6, wherein the plural pressing dies (410, 411, 412, 413) of the stamping machine (4) in the step c) are sequentially designated as a first pressing die (410), a second pressing die (411), a third pressing die (412) and a fourth pressing die (413), which respectively correspond to the first machining position (400), the second machining position (401), the third machining position (402) and the fourth machining position (403).

9. The leveling method for burying an evaporating section of a heat pipe into a thermally conductive seat according to claim 1, wherein a plurality of guiding rods (414) are extended downwardly from the punch (41) of the stamping machine (4) in the step c), and wherein the platform (40) are arranged a plurality of guiding holes (404), through which the guiding rods (414) maintain a predetermined depth that the punch (41) presses down.

* * * * *